US005715713A

United States Patent [19]

Aubry et al.

[11] Patent Number: 5,715,713

[45] Date of Patent: Feb. 10, 1998

[54] DOOR LATCH LOCKING ACTUATOR ASSEMBLY

[75] Inventors: Michael Eugene Aubry, Shelby Township, Macomb County; Lloyd Walker Rogers, Jr., Shelby Township; David Gerard Hlavaty, Northville; Thomas Adam Dzurko, Macomb, all of Mich.

[73] Assignee: General Motors Corporation, Detroit, Mich.

[21] Appl. No.: 585,185

[22] Filed: Jan. 11, 1996

[51] Int. Cl.[6] ..... E05B 47/00

[52] U.S. Cl. ..... 70/277; 70/264; 292/201; 292/216

[58] Field of Search ..... 70/262–264, 275, 70/277, 237, DIG. 30, DIG. 42; 292/144, 201, 216, DIG. 3, DIG. 23, DIG. 26, DIG. 62, DIG. 67

[56] References Cited

U.S. PATENT DOCUMENTS

| | | | |
|---|---|---|---|
| 4,364,249 | 12/1982 | Kleefeldt et al. | 70/264 |
| 4,756,563 | 7/1988 | Garwood et al. | 292/216 |
| 4,974,886 | 12/1990 | Kleefeldt et al. | 70/264 X |
| 4,978,154 | 12/1990 | Kleefeldt et al. | 292/216 X |
| 5,054,300 | 10/1991 | Nakahara et al. | 70/264 X |
| 5,078,436 | 1/1992 | Kleefeldt et al. | 70/264 X |
| 5,117,665 | 6/1992 | Swan et al. | 70/264 |
| 5,154,457 | 10/1992 | Watanabe | 292/216 |
| 5,154,460 | 10/1992 | Bartsch | 292/216 X |
| 5,419,597 | 5/1995 | Brackmann et al. | 70/264 X |
| 5,438,855 | 8/1995 | Ikeda | 292/216 X |
| 5,453,671 | 9/1995 | Baier et al. | 70/277 X |
| 5,497,641 | 3/1996 | Linde et al. | 70/277 X |
| 5,535,607 | 7/1996 | Dzurko et al. | 70/277 X |
| 5,537,848 | 7/1996 | Grzanka et al. | 292/201 X |
| 5,538,298 | 7/1996 | Ikeda | 292/DIG. 23 X |

*Primary Examiner*—Suzanne Dino
*Attorney, Agent, or Firm*—Charles E. Leahy

[57] ABSTRACT

A door latch has a control lever operable between an unlocked position permitting normal unlatching of the latch and a locking position preventing unlatching of the latch. A locking lever is pivoted on a housing and operably connected with the lock control lever so that pivoting of the locking lever will operate the lock control lever. The locking lever has a slot receiving a pin carried by a pin control link. An inside lever is pivoted on the housing and operably connected with the inside locking button so that operation of the inside locking button pivots the inside lever. The inside lever has an L-shaped slot, which overlies an elongate slot of the locking lever. A drive pin carried by a control link is captured within the slots. The control link is mounted on a rack which is motor operated. In an extended position of the rack, the control link establishes the drive pin at a position within the slots connecting the locking lever and inside lever for rotation so that movement of the inside lock button between the lock and unlock positions will pivot the inside lever and the locking lever to operate the lock control lever. When the rack is extended by actuating the motor, the control link moves the pin to align with a bypass pocket of the L-shaped slot so that the locking lever remains at rest during movement of the inside lever by the inside locking button.

3 Claims, 7 Drawing Sheets

DOOR LATCH LOCKING ACTUATOR ASSEMBLY

The invention relates to a vehicle door latch and, more particularly, provides a door latch in which an inside lock button is effectively isolated from unlocking the door latch when the door latch is locked by operating the outside key cylinder.

BACKGROUND OF THE INVENTION

It is well known in motor vehicles to latch a door in the closed position with a door latch. The latched door is subsequently unlatched by operating either an outside door handle or an inside door handle.

In addition, conventional door latches include a locking mechanism by which the door latch can be locked to prevent unauthorized unlatching. The door latch is locked and unlocked by operating a locking button mounted on the inside of the door for convenient access by the occupant. Alternatively, when the occupant is outside the vehicle, the door latch can be locked and unlocked by rotating a key operated cylinder.

The prior art has recognized that a person seeking unauthorized access into the vehicle without a key can break the window, reach inside, and operate the manual unlock button, thereby unlocking the door latch so that the door can be opened by using either the outside door handle or the inside door handle. The prior art has recognized the advantage of a door lock operating system in which the locking of the door latch via use of the outside key cylinder will in some manner then prevent a subsequent unlocking of the door lock via operation of the inside locking button. Accordingly, once the occupant has alighted from the vehicle and used a key to lock the door, the door can not be subsequently opened by breaking the window and reaching in to operate the manual locking button.

The present invention provides a new and improved mechanism for performing the aforedescribed function of disabling the inside door locking button upon locking of the door via the outside key-operated cylinder.

SUMMARY OF THE INVENTION

According to the present invention, the vehicle door latch has a conventional control lever which is operable between an unlocked position which permits normal unlatching of the door latch and a locking position which prevents unlatching of the door latch. A locking lever is pivotally mounted on a housing and operably connected with the lock control lever so that pivoting of the locking lever will, in turn, operate the lock control lever. The locking lever has a slot which receives a pin carried by a pin control link. An inside lever is pivotally mounted on the housing and is operably connected with the inside locking button so that operation of the inside locking button will always pivot the inside lever. The inside lever has an L-shaped slot, which overlies an elongate slot of the locking lever. The drive pin carried by the pin control link is captured within the slots. The control link is mounted on a rack which is motor operated between an extended position and a retracted position. In the extended position, the control link establishes the drive pin at a position within the slots of the locking lever and inside lever at which these levers are effectively connected together for unitary rotation so that movement of the inside lock button between the lock and unlock positions will, in turn, pivot the inside lever and the locking lever to operate the lock control lever. Thus, the inside locking button is normally effective to lock and unlock the door lock. When the rack is retracted by actuating the motor, the control link moves the pin to align with a bypass pocket of the L-shaped slot so that the locking lever remains at rest during movement of the inside lever by the inside locking button. Thus, the door cannot be unlocked by breaking the glass and operating the inside button until the rack is again retracted.

IN THE DRAWINGS

Referring to the drawings.

DESCRIPTION OF THE PREFERRED EMBODIMENT

Figure 1:
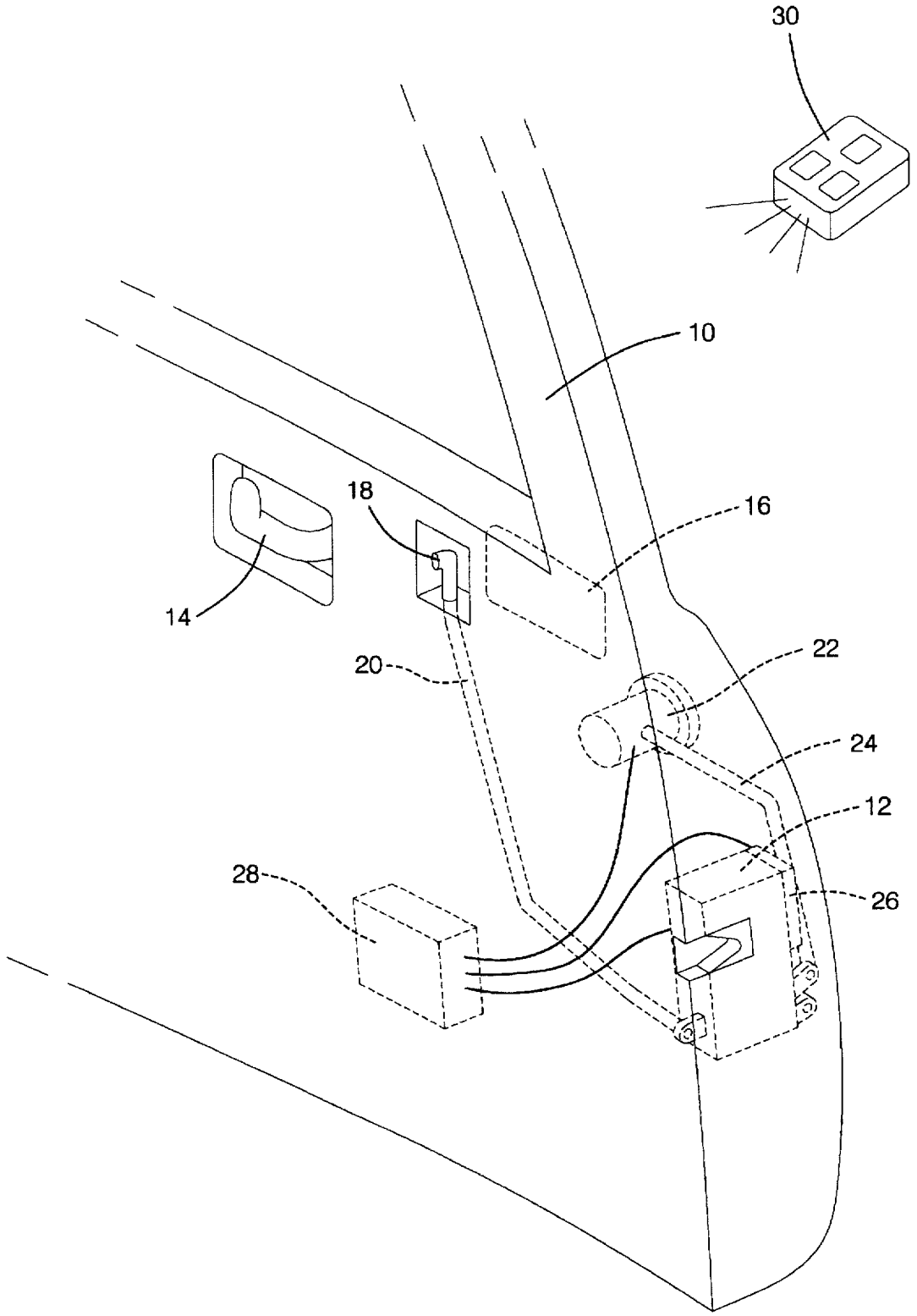
FIG. 1 is a perspective view of a vehicle door and a door latch having a locking actuator according to the invention.

As seen in FIG. 1, a conventional vehicle door 10 is hingedly mounted on a vehicle body and carries a door latch assembly generally indicated at 12. Upon closing of the door 10, the door latch 12 becomes latched with a striker mounted on the vehicle body to retain the door 10 in latched position. The door can be reopened by unlatching the door latch 12 via either an inside handle 14 or an outside handle 16.

In order to secure the door 10 against unauthorized entry, the door latch 12 also includes a locking mechanism which is built into the door latch 12 for locking the door latch 12. This door locking mechanism can be locked and unlocked by the seated occupant via an inside locking button 18 which is reciprocally mounted and connected to the door latch 12 by a control rod 20. Alternatively, the door latch 12 may be locked and unlocked via an outside key cylinder 22 which is connected to the door latch 12 by a control rod 24. Still further, the door latch can be locked and unlocked by actuation of the power lock actuator 26 which is electrically operated by a control module 28. The control module 28 is, in turn, energized by a remote transmitter 30 which the vehicle user carries as a key fob.

Figure 2:
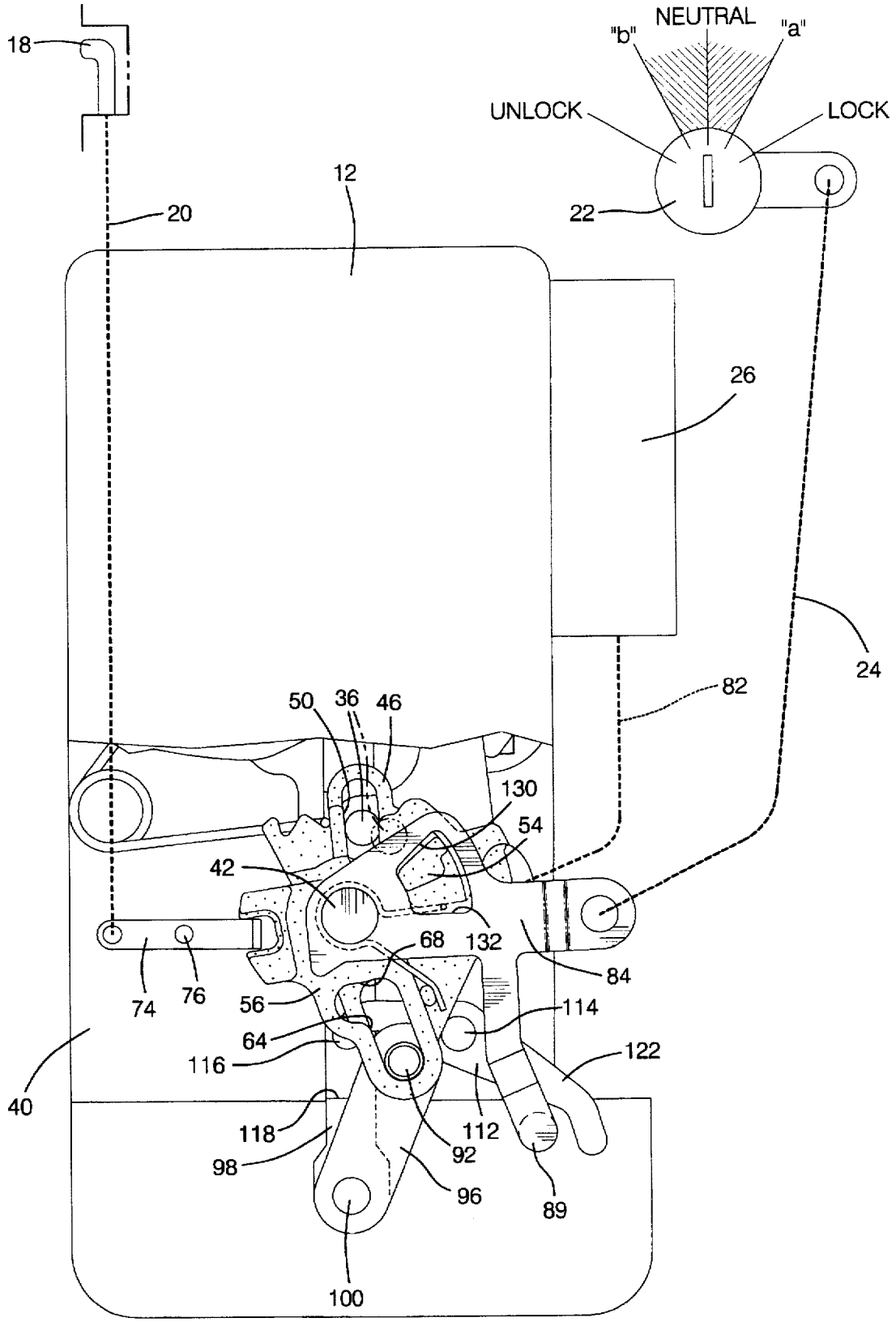
FIG. 2 is an enlarged fragmentary view of FIG. 1 showing the normal unlocked condition of the door latch assembly with parts broken away and showing a key cylinder, a power lock actuator and an inside locking button in schematic representation.

Referring now to FIG. 2, the door latch 12 is shown as a box without reference to the inner workings thereof, it being understood that the door locking actuator of the present invention may be employed in conjunction with many of the door latches conventionally employed in the auto industry. One such door latch assembly is shown in U.S. Pat. No.

4,756,563. The door latch 12 includes a door lock control lever 36 which projects outwardly of the latch assembly 12. In FIG. 2, the control lever 36 is shown at its position in which the door latch 12 is unlocked to permit latching and unlatching of the door latch 12 by either the inside or outside door handles. The door lock control lever 36 may be moved rightwardly to the phantom line indicated position of FIG. 2 in which the door latch 12 is locked.

The following description of the preferred embodiment describes the actuator assembly for moving this control lever 36 between its solid line indicated unlocked position of FIG. 2 and its phantom line indicated locked position of FIG. 2.

As seen in FIG. 2, the locking actuator assembly includes a housing wall 40 which mounts a pivot pin 42. A plurality of pivoting levers are stacked on the pivot pin 42.

Figure 9:
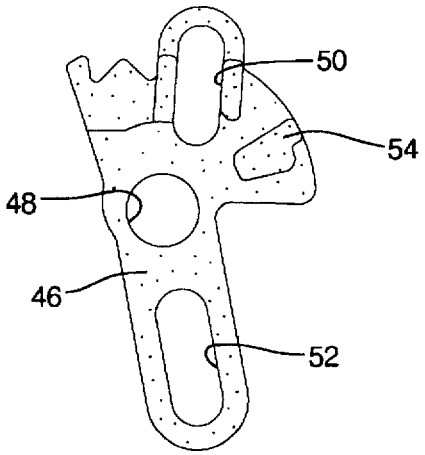

As seen in FIGS. 2 and 9, a locking lever 46 has an aperture 48 which receives the pivot pin 42, and a slot 50 which closely receives the lock control lever 36 as seen in FIG. 2. The locking lever 46 also has an elongated slot 52 therein. It will be understood that rotation of the locking lever 46 will move the lock control lever 36 between the solid line indicated locked position and the phantom indicated unlocked positions of FIG. 2. The locking lever 46 also has an abutment 54 which projects from the face thereof and will be discussed hereinafter.

Figure 8:
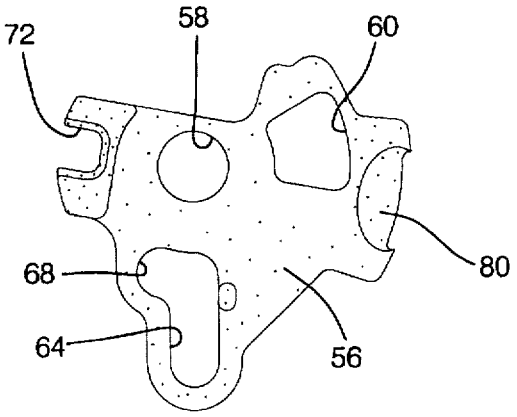

An inside lever 56, as seen in FIGS. 2 and 8, has an aperture 58 which receives the pivot pin 42 so that the inside lever 56 is stacked on the lock lever 46. The inside lever 56 has an oversize cutout 60 which receives the abutment 54 of locking lever 46. The inside lever 56 has an L-shaped slot 64 which registers with the elongated slot 52 of locking lever 46 and also has a bypass pocket 68 to be discussed hereinafter. The inside lever 56 has a fish mouth opening 72 which, as shown in FIG. 2, receives a toggle lever 74 mounted on pivot 76 and connected to the connector rod 20 of inside locking button 18. Thus, as seen in FIG. 2, moving the locking button 18 downwardly in the door locking direction pivots the toggle lever 74 to, in turn, rotate the inside lever 56 clockwise about pivot pin 42. Inside lever 56 has a second fish mouth 80 which, as seen in FIG. 2, is connected to the power lock actuator 26 by connecting rod 82. Accordingly, actuating the power lock actuator 26 will also pivot the inside lever 56 about the pivot pin 42.

Figure 7:
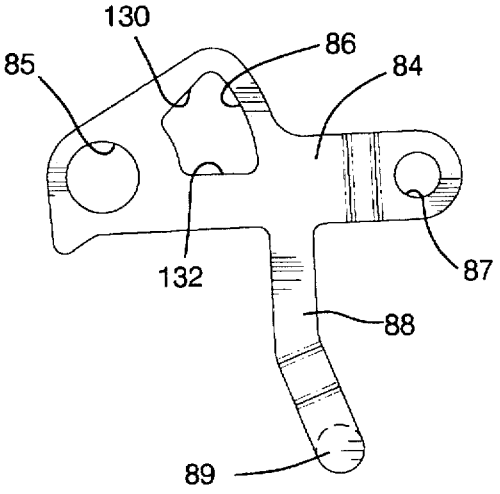
FIGS. 7, 8, 9, 10 and 11 show various levers of the latch actuator assembly of this invention.

As seen in FIGS. 2 and 7, a key cylinder lever 84 is stacked atop the inside lever 56 and has an aperture 85 which receives the pivot pin 42. An oversize cutout 86 receives the abutment 54 of the inside lever 46. An aperture 87 receives the control rod 24 connected to the outside key cylinder 22. A leg 88 depends downwardly and has a lateral offset foot 89 which will be discussed hereinafter.

As seen in FIG. 2, the locking lever 46 and the inside lever 56 are drivingly connected together by a drive pin 92 which is captured within the elongated slot 52 and the L-shaped slot 64. The drive pin 92 is normally established at the lower region of the slots 52 and 64 by a control link 96 which carries the drive pin 92. The control link 96 is mounted on a rack 98 by a pivot pin 100. The rack 98 is moved up and down between a downward extended position of FIGS. 2, 3 and 4 and an upward retracted position of FIGS. 5 and 6 via a motor 104, pinion 106 and rack teeth 108 carried on the rack 98.

Figure 10:
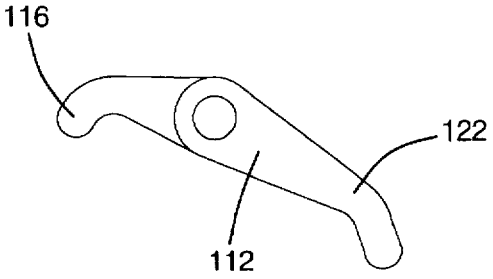
Figure 11:
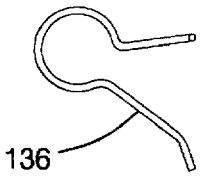

A reset lever 112, shown in FIGS. 2 and 10, is mounted on a pivot pin 114 of the housing wall 40. A first end 116 of the reset lever 112 overlies and aligns with a shoulder 118 provided on the rack 98. The other end 122 of reset lever 112, is poised to be engaged by the offset foot 89 of leg 88 of the key cylinder lever 84.

Normal Unlocked Condition

FIG. 2 shows a normal position of the door latch 12 in which the door latch 12 remains unlocked to permit opening of the door 10 via either the inside handle 14 or the outside handle 16. The lock control lever 36 is in the unlocked position.

Locking the Door from Inside

Figure 3:
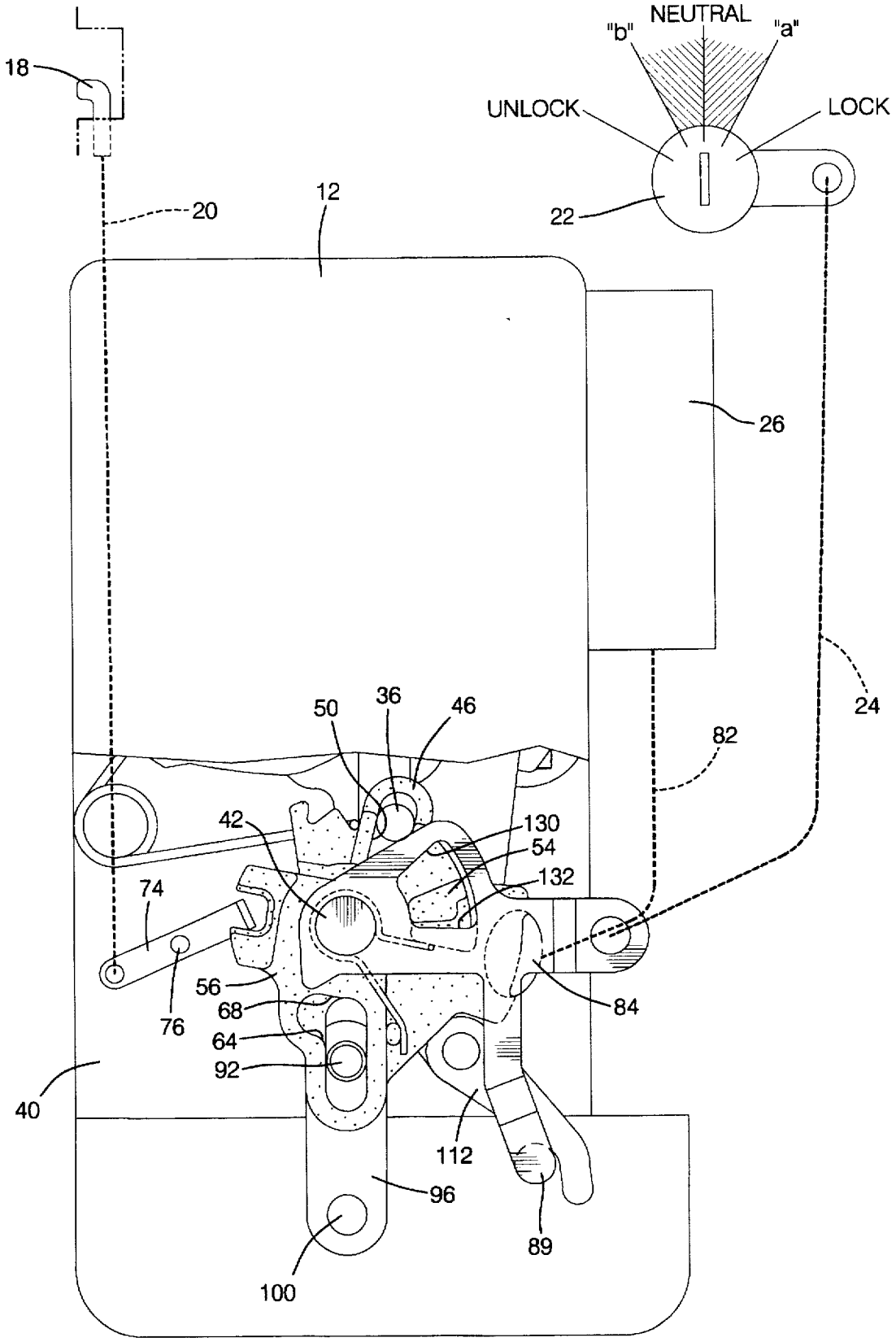
FIG. 3 is a view similar to FIG. 2 but showing the latch having been locked by depressing the inside locking button; showing the latch being locked by turning the outside key cylinder.

As shown in FIG. 3, the door 10 can be readily locked by pressing the locking button 18, which, in turn, pivots the toggle lever 74 and rotates the inside lever 56 in the clockwise direction. The drive pin 92 captured in the slot 64 of inside lever 56 and the slot 52 of the lock lever 46 causes the lock lever 46 to be rotated clockwise in unison with the inside lever 56 so that the control lever 36 captured in the slot 50 is moved rightwardly to the locked position of FIG. 3. During rotation of the locking lever 46 and inside lever 56, the control link 96 pivots counterclockwise about its pivot pin 100 and the drive pin 92 creeps upwardly in the slots 52 and 64.

It will be understood that the clockwise rotation of the inside lever 56 will pull downwardly on the control rod 82 associated with the power lock actuator 26.

Unlocking the Door from Inside

Referring again to FIG. 3, it will be understood that the door is unlocked from the inside by lifting the locking button 18 upwardly thereby pivoting the toggle link 74 and returning the inside lever 56 in the counterclockwise direction. The L-shaped slot 64 of the inside lever, moves drive pin 92 counterclockwise. The drive pin 92 carries the locking lever 46 counterclockwise and the slot 50 carries the control lever 36 leftwardly to the normal unlocked position of FIG. 2.

Locking the Door from Outside

Figure 4:
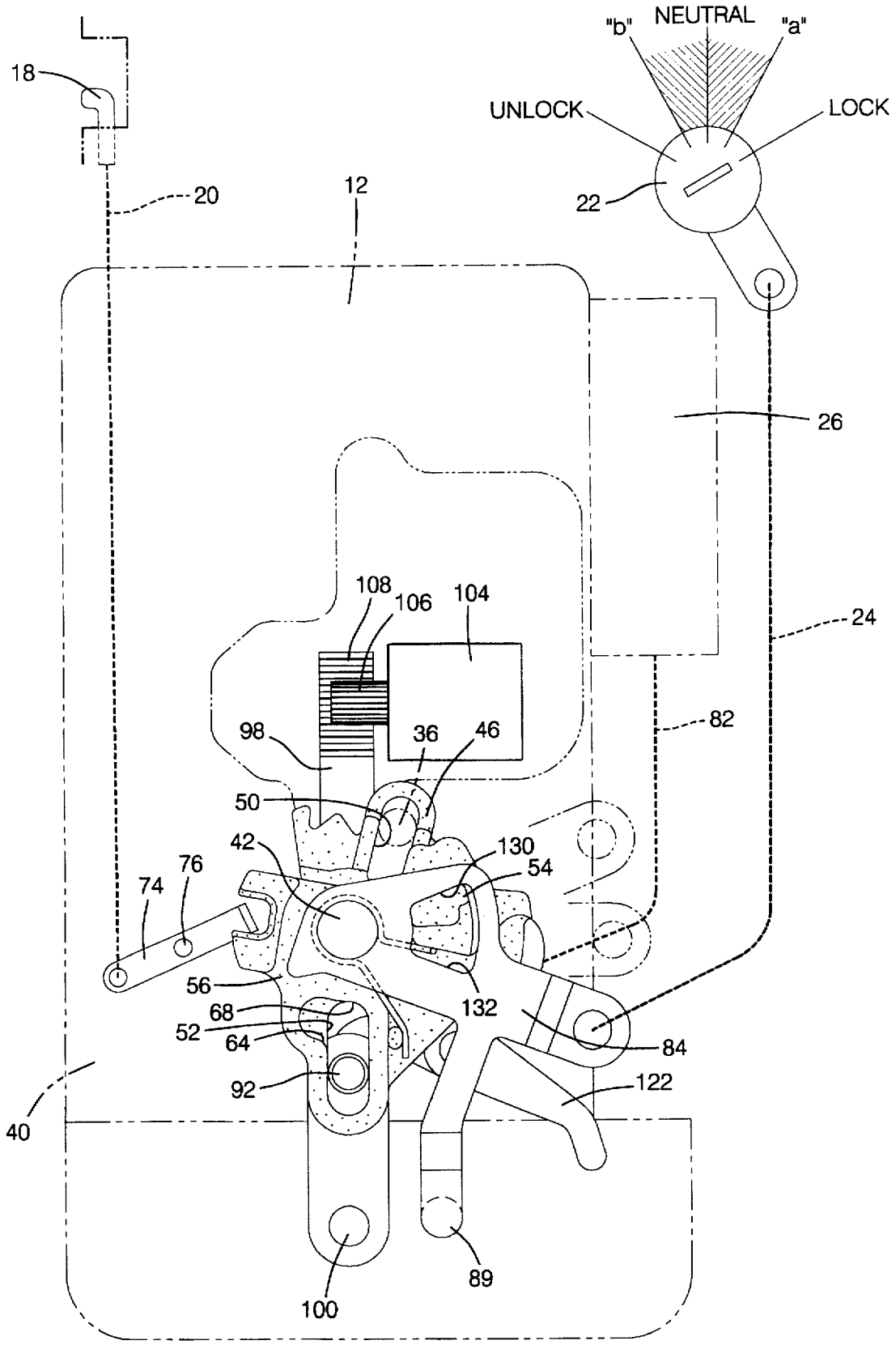
FIG. 4 is a view similar to FIG. 3 but having additional parts broken away to show a motor operated rack and pinion for establishing the latch in a normal condition for locking and unlocking under the control of either an inside lock button or an outside key cylinder, and showing the latch being locked by turning the outside key cylinder.

FIG. 4 shows that the vehicle user has inserted a key to turn the lock cylinder 22 clockwise in order to lock the door from outside the vehicle. During the initial turning movement of the lock cylinder 22, a switch contact "a" is closed to complete an electrical circuit to the control module 28. Control module 28, in turn, energizes the power actuator 26 which moves the control rod 82 downwardly and forcibly rotates the inside lever 56 in the clockwise direction. In turn, the drive pin 92 captured within the overlying slots 64 of the inside lever and 52 of the locking lever will rotate the locking lever 52 clockwise so that the locking lever slot 50 moves the control lever 36 rightwardly to the locked position shown in FIG. 4.

Simultaneously, the clockwise rotation of the inside lever 56 will cause the toggle lever 74 to be pivoted counterclockwise thereby pulling downwardly on the control rod 20 and the locking button 18.

It will be understood and appreciated that the key cylinder 22 is a conventional door lock cylinder and the user returns the key to the neutral position in order to remove the key from the key cylinder. The control rod 24, in turn, returns the key cylinder lever 84 to the neutral position of FIG. 4 while the oversize cutout 86 permits this return of key cylinder lever 84 without moving the abutment 54 of the locking lever 46 so that the control lever 36 is not disturbed from its locked position as the key cylinder 22 returns to the neutral position.

In the event of a power failure, the power actuator 26 cannot lock the latch as described above. However, as seen by comparing FIGS. 2 and 4, the clockwise rotation of the key cylinder lever 84 by control rod 24 causes an end wall 130 of the oversize cutout 86 of the key cylinder lever 84 to engage with the abutment 54 of the locking lever 54 so that the locking lever 54 is carried in the clockwise direction and its slot 50 moves the lock control lever 36 rightwardly from the unlocked position of FIG. 2 to the locked position of FIG. 4.

Locking and Unlocking the Door with the Remote Transmitter

It will be understood that in addition to locking and unlocking the door with the locking button 18 or the key cylinder 22, the door lock can be readily locked and unlocked using the remote keyless entry transmitter 30. Pressing the lock button on the transmitter sends a signal to the control module 28 which, in turn, energizes the power actuator 26 to lower control rod 82 and lock the door by rotating the inside lever 56 clockwise so that drive pin 92 also rotates the locking lever 46. Pushing the unlock button on the transmitter 30 signals the control module 28 to actuate the power actuator to lift the control rod 82.

Disabling of the Inside Lock Button

A particular advantage of the present invention is that the door latch may be locked in a manner which prevents a subsequent unlocking of the latch via the inside locking button 18.

Figure 5:
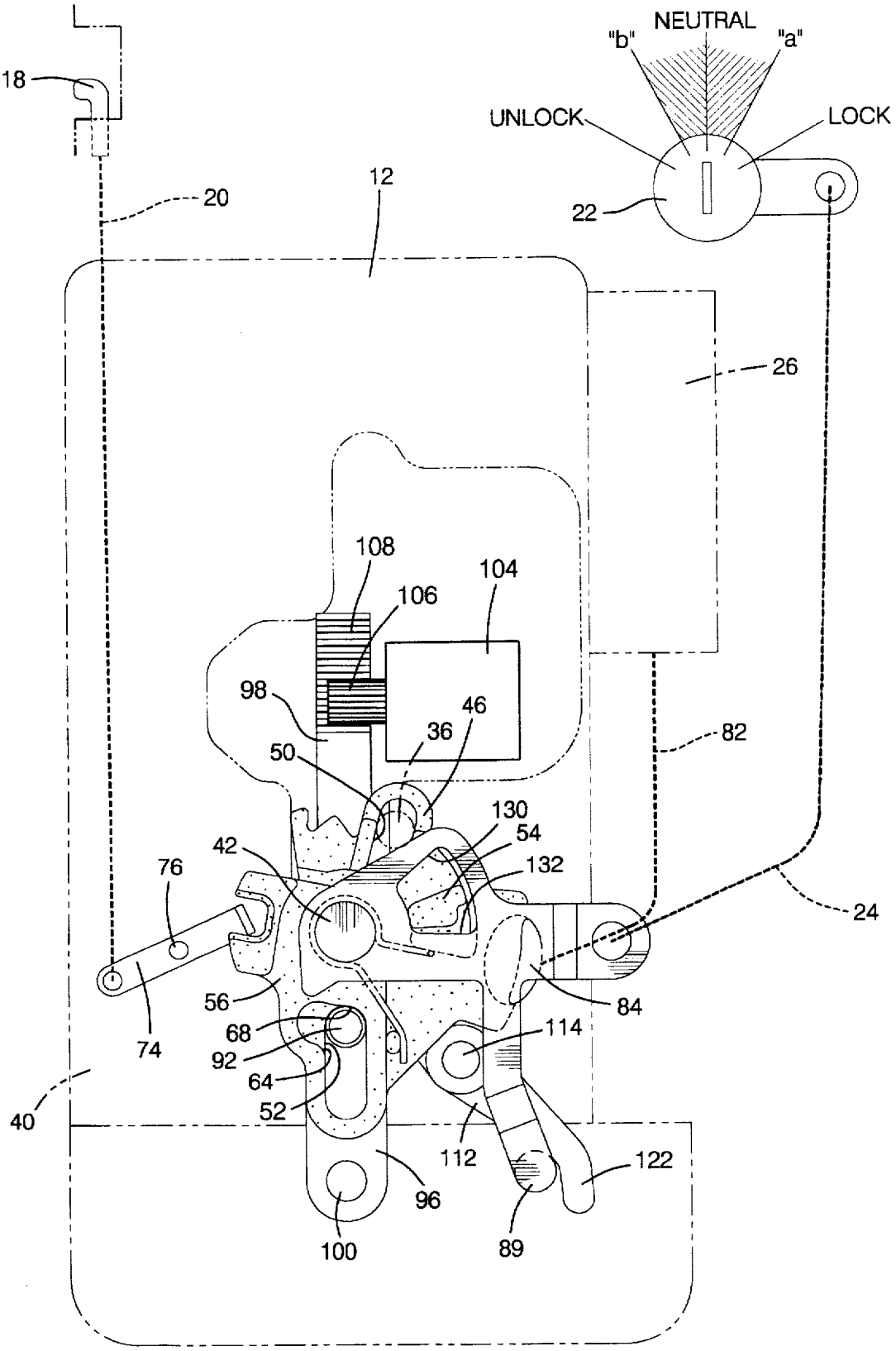
FIG. 5 is a view similar to FIG. 2 but showing a motor having retracted a rack to establish a by-pass condition in which the door latch cannot be unlocked by operating the inside lock button.

FIG. 5 shows the door latch in the already locked condition which has been obtained by rotating the key cylinder to the locked position, as described herein before with reference to FIG. 4 of the drawings.

Figure 6:
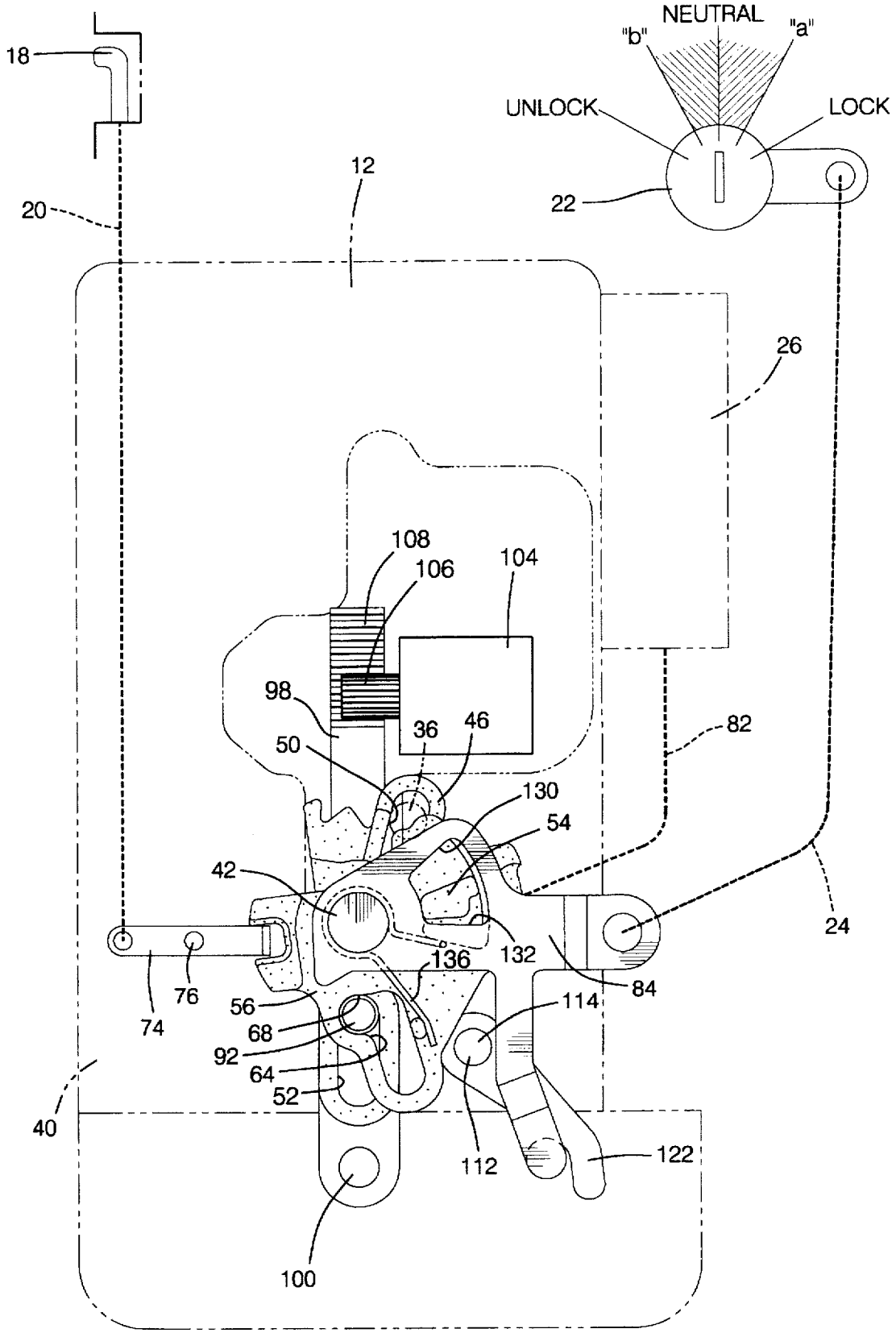
FIG. 6 is a view similar to FIG. 2 but showing an attempt to unlock the door latch using the inside locking button.

FIG. 5 shows that the motor 104 has been energized to drive pinion 106 and rack teeth 108 to retract the rack 98 upwardly. This upward movement of the rack 98 carries the control link 96 upwardly and in so doing, raises the drive pin 92 into the upper region of the elongated slot 52 of locking lever 46 and into alignment with the bypass portion 68 of the L-shaped slot 64 of the inside lever 56. Accordingly, as seen in FIG. 6, if the locking button 18 is lifted, the toggle link 74 is pivoted and rotates the inside lever 56 counterclockwise. However, as seen in FIG. 6, during this counterclockwise rotation of the inside lever 56 the pin 92 is swallowed by the bypass portion 68 of the L-shaped slot 64 so that the drive pin remains stationary and the locking lever 46 is not moved. Thus, it is seen that the pin 92 and bypass portion 68 cooperate to provide a lost motion connection between the inside lever 56 and the locking lever 46 by which the inside lever will free-wheel relative the control lever 36 so that the control lever 36 remains in its locked position even though the locking button 18 has been lifted. Then, when the vehicle user releases the button 18, the hair pin spring 136 acting between the inside lever 56 and the locking lever 46 will return the inside lever 56, toggle lever 74 and lock button 18 to their respective locked conditions, as shown in FIG. 5.

Thus, it will be understood that a person seeking unauthorized entry into the vehicle cannot simply break a window and reach into the car to manipulate the inside locking button 18. Instead, in order to gain authorized entry to the vehicle and open the door, the user must be in possession of a properly bitted key.

Restoring the Lock Actuator to Permit Unlocking with the Inside Button

In order to restore the door latch for normal unlocking by the inside button 18, the key is inserted into the key cylinder 22 and the key cylinder 22 rotated to the unlock position. Rotation of the key cylinder to the position labeled "b" closes a set of switch contacts and sends a signal to the control module 28. The control module, in turn, first sends a signal to energize the motor 104 so that pinion 106 and rack 108 move the rack 98 downwardly to return to the extended position of FIG. 3 so that the drive pin 92 is reestablished at the lower region of the slots 52 and 64. After the rack 98 has been extended., control module 28 then actuates the power lock actuator 26 to raise the control rod 82 which, in turn, rotates the inside lever 56 in the counterclockwise direction. Drive pin 92, captured by the slot 64, in turn rotates locking lever 46 counterclockwise to return the control lever 36 to the unlocked position.

Restoring the Lock Actuator to Permit Unlocking by the Inside Button in the Event of a Power Failure Referring again to FIG. 5, it will be understood that power failure may prevent the energization of motor 104 to return the rack 98 downwardly as discussed herein before. In the event of such a power failure, rotation of the key cylinder 22 to the unlocked condition will lift the control rod 24 and forcibly rotate the key cylinder lever 84 in the counterclockwise direction. In this event, the offset foot 89 of key cylinder lever 84 engages and lifts the end 122 of reset lever 112 so that the other end 116 of the reset lever moves downwardly and engages with the shoulder 118 on the rack and forcibly extends the rack 98 downwardly by backdriving the motor 104. Accordingly, the drive pin 92 is reestablished at its normal driving condition between the inside lever 56 and locking lever 46. Simultaneously, the ongoing rotation of the key cylinder 22 pivoting the key cylinder lever 84 causes the end wall 132 of the oversize cutout 86 to engage with the abutment 54 of locking lever 46 so that the locking lever is rotated counterclockwise and its slot 50 moves the control lever 36 leftwardly to the unlocked position. When the vehicle user releases the key, the key cylinder returns to the neutral position as the oversize cutout 86 of the key cylinder lever 84 permits the abutment 54 to remain at rest.

Thus, it is seen that the invention provides a new and improved lock actuator for a door latch.

We claim:

1. In a door latch of the type having a lock control lever which is operable between an unlock position which permits normal unlatching of the door latch and a lock position which prevents unlatching of the door latch, an inside locking button which is operable for actuating the lock control lever; and an outside key operated cylinder which is operable for alternatively actuating the lock control lever; the improvement comprising;

a housing;

a locking lever pivotally mounted on the housing and operably connected with the lock control lever;

a key cylinder lever pivotally mounted on the housing and operably connected with the key operated cylinder;

an inside lever pivotally mounted on the housing and operably connected with the inside locking button;

a lost motion connection acting between the inside lever and the locking lever includes a drive pin extending into overlying slots of the inside lever and the locking lever and having a normal driving position establishing a driving connection therebetween so that operation of the inside locking lever by the inside button operates the latch between locked and unlocked positions, said drive pin being movable to a bypassing condition in which the inside lever is permitted to free wheel relative the locking lever so that operation of the inside button is unable to operate the lock control lever to unlatch the door latch; and a motor operated in response to rotation of the key operated cylinder to a locking position and operably connected with the drive pin to operate the drive pin between the driving position and the bypassing condition.

2. The latch of claim 1 further comprising a drive pin carried by a control link, and the motor drives a rack and pinion to operate the control link and thereby translate the pin within the overlying slots of the inside lever and the locking lever.

3. The latch of claim 2 further comprising the lost motion connection being restored from the bypassing condition to the normal driving condition by energizing the motor to drive the rack and pinion, and further characterized by the provision of a lever acting between the key cylinder lever and the rack to drive the rack irrespective of failure of the motor to drive the rack.

* * * * *